US009376878B2

(12) United States Patent
Isaksen

(10) Patent No.: US 9,376,878 B2
(45) Date of Patent: Jun. 28, 2016

(54) APPARATUS AND METHOD FOR SETTING A CEMENTITIOUS MATERIAL PLUG

(71) Applicant: Inger Isaksen, Bovey Tracey (GB)

(72) Inventor: Inger Isaksen, Bovey Tracey (GB)

( * ) Notice: Subject to any disclaimer, the term of this patent is extended or adjusted under 35 U.S.C. 154(b) by 228 days.

(21) Appl. No.: 14/178,822

(22) Filed: Feb. 12, 2014

(65) Prior Publication Data

US 2014/0231068 A1 Aug. 21, 2014

(30) Foreign Application Priority Data

Feb. 21, 2013 (GB) ..... 1303089.5

(51) Int. Cl.
*E21B 23/06* (2006.01)
*E21B 33/134* (2006.01)
*E21B 33/16* (2006.01)

(52) U.S. Cl.
CPC ..... *E21B 23/06* (2013.01); *E21B 33/134* (2013.01); *E21B 33/16* (2013.01)

(58) Field of Classification Search
CPC .... E21B 23/06; E21B 33/1204; E21B 33/134
See application file for complete search history.

(56) References Cited

U.S. PATENT DOCUMENTS

| | | | | |
|---|---|---|---|---|
| 1,631,419 | A * | 6/1927 | Kinley | E21B 33/1204 166/117 |
| 2,922,478 | A | 1/1960 | Packer | |
| 2,978,029 | A | 4/1961 | O'Reilly et al. | |
| 3,417,824 | A * | 12/1968 | Poollen | E21B 33/134 166/117 |
| 4,464,993 | A | 8/1984 | Porter | |
| 4,464,994 | A | 8/1984 | Porter | |
| 6,269,878 | B1 | 8/2001 | Wyatt et al. | |
| 2004/0144538 | A1 | 7/2004 | Richard et al. | |
| 2007/0027245 | A1 * | 2/2007 | Vaidya | C08C 19/00 524/424 |
| 2011/0162844 | A1 | 7/2011 | Mauth et al. | |

FOREIGN PATENT DOCUMENTS

DE 10258300 A1 6/2004

OTHER PUBLICATIONS

IPO Search Report, Mar. 26, 2014.

* cited by examiner

*Primary Examiner* — William P Neuder
(74) *Attorney, Agent, or Firm* — Bradley D. Crose; Crose Law LLC

(57) ABSTRACT

During the process of drilling for hydrocarbons, there is often the need to set a cementitious material plug in an open hole to allow the process of sidetracking and drilling of a new well bore. The present invention provides an apparatus and method for setting a cementitious material plug in an irregularly shaped and/or over gauge well bore without contamination of the cementitious material by extruding a membrane filled with cementitious material from a membrane delivery device.

19 Claims, 2 Drawing Sheets

APPARATUS AND METHOD FOR SETTING A CEMENTITIOUS MATERIAL PLUG

CROSS-REFERENCE TO RELATED APPLICATION(S)

The present non-provisional patent application claims the benefit of priority of GB 1303089.5, which is entitled "APPARATUS AND METHOD FOR SETTING A CEMENTITIOUS MATERIAL PLUG", which was filed on Feb. 21, 2013, and which is incorporated in full by reference herein.

FIELD OF THE INVENTION

The present invention relates generally to an apparatus and method for setting cementitious material plugs in a wellbore and finds particular, although not exclusive, utility in sidetrack drilling operations.

BACKGROUND OF THE INVENTION

During the process of drilling for hydrocarbons, there is often the need to set a cementitious material plug in an open hole to allow the process of sidetracking and drilling of a new well bore. It is possible to drill multilateral wells into different parts of a reservoir from a single wellbore by a method known as directional drilling. Many directional wells are drilled to reach reservoirs inaccessible from a point directly above because of surface obstacles and/or geologic obstruction. Wellbore sidetrack drilling operations with hard cementitious material plugs are well known in the art. Wellbore sidetrack drilling comprises placing a cementitious material plug in a borehole and allowing the cementitious material to develop high compressive strength. The hardened cementitious material plug may deflect a drill bit away from the current borehole, starting another open hole section. Conventional cementitious material formulations for sidetrack kickoffs usually fail when the ROP (Rate of Penetration) for the cementitious material plugs is much higher than the ROP in the surrounding formation. Sidetracking failure, in building up a kickoff angle, results in operational delay and cost overrun.

Generally, a length of approximately 20 m to 30 m of good cementitious material is required in a well bore to form a plug in order to perform a successful side track. Poor cementitious material can lead to failure to create successful sidetracks, requiring further work placing cementitious material plugs or other remedial work that is expensive to rig operators. In sidetrack operations, an average of 2.4 attempts per sidetrack, with 24 hours with each attempt, has been reported and experienced in the field. Failures in sidetrack cementitious material plugs can occur because of plug slippage, insufficient plug curing time, insufficient slurry volume, slurry composition, slurry losses while extracting equipment, and/or poor mud removal (e.g. due to using an unsuitable spacer).

Cementitious material plugs are placed in oil and gas wells for various reasons other than sidetracking, including well abandonment, squeezing (e.g. where a cementitious material slurry is injected into an isolated zone) and zone isolation. Cementitious material plug placement may be used to block off a hole, for subsequent re-drilling through the cementitious material plug. This may be the case if curing down hole mud losses, or exceptionally if stability of the hole walls is low or if there is a risk of hole collapse.

There can be great difficulty in placing good cementitious material in sections of a hole if there are large washouts (e.g. where the diameter of the hole suddenly increases, forming a cavern type region, due to for instance partial hole collapse). Sometimes washouts can be up to twice the diameter of a drilled hole. In rare cases, washouts can be more than twice the diameter of a drilled hole. The current procedure is to pump excess cementitious material to fill an over-gauge wellbore. This is not effective in all situations as the velocity of the pumped cementitious material in an annulus between a down hole assembly and the interior surface of a well bore (i.e. the 'annular velocity' of the pumped cementitious material) is so low that mixture of the cementitious material with drilling mud can occur, which contaminates the cementitious material preventing it from gaining full strength; i.e. contamination reduces the strength of the cementitious material.

Density, rheology and hole angle are major factors affecting plug success. While the Boycott effect (i.e. that sediment settles faster in an inclined hole, and slide as a mass to the lower side of an inclined borehole) and an extrusion effect (e.g. the flow of liquid slurry out of a delivery device) are predominant in inclined wellbores, a spiralling or "roping" effect controls slurry movement in vertical wellbores. Current understanding of down hole flow mechanics is unable to explain all of the unsuccessful attempts at forming cementitious material plugs. For example, plug tops have varied with no apparent pattern, and some plugs have drilled softer than expected. Although large excess volumes of cementitious material are commonly used to improve the chances of success, in such jobs, these volumes can pose other problems. For example, the plug top may be extremely high, which would result in excessive rig time for drilling new formation, and larger volumes of cementitious material-contaminated mud will likely result. Concerns are also commonly raised about the capability of successfully pulling a work string out of the resulting long slurry columns before the onset of cementitious material gelation and/or hydration.

Long-term plug stability based on accepted industry standards is highly debatable. Abandonment plugs fail, despite the fact that they were thought to have been properly set according to all regulatory guidelines. Factors affecting plug stability include, but are not limited to only: wellbore angle including vertical, deviated and horizontal; hole size; spotting fluid and wellbore fluid rheologies and densities; and work string and/or hole diameter annulus.

In conventional wellbore drilling, a first section of a hole may be drilled and a casing (for instance, made of metal) may then be run into that first section, which may be secured in place by cementitious material. A second section of hole may be drilled as a continuation of the first section. The second section is often of a smaller diameter, due to the drill bit being limited in size by the internal diameter of the casing present in the first section. That is, at each stage, the diameter of hole is limited by the size of tool that can be run through the internal diameter of the previous stage's casing. Wellbores can reach around 10 km in length. However, it is known to use an underreaming tool that can make the second section have a larger diameter than the internal diameter of the casing in the first section. In this case, the underreaming tool may be run through the metal casing of the first section in a collapsed state. An example of such an underreaming tool/underreamer is the custom built Underreamer "ADT" model produced by Adriatech S.r.l. of Pescara, Italy. Therefore, in practice, the diameter of hole to be filled with cementitious material may be larger or smaller, or the same size, as a section of hole through which a cementitious materialing assembly must be run.

US2011/0162844A1 discloses a bottomhole assembly for placing a cementitious material plug in a wellbore, comprising an elongate support structure having annular seals that slide against the internal surface of a hole or hole casing. The seals are provided at opposing ends of the support structure, and cementitious material is pumped into the annular region between the seals. The support structure is left in the well after the cementitious material has cured.

U.S. Pat. No. 6,269,878 describes a bottomhole assembly for plugging a wellbore, comprising a runner configured for connection to a drill pipe and for delivering cementitious material down hole, and a packer for anchoring the cementitious material in the wellbore, the packer being connected to the exterior of one end of the runner and comprises a rigid structural part supporting an expandable cover. Cementitious material is pumped into the expandable cover, which remains connected to the rigid structural part. The rigid structural part may be disconnected from the drill pipe, and is left in the well after the cementitious material has cured.

Poly Diamond Crystalline (PDC) drill bits are generally favoured because they produce higher drilling rates, are longer lasting for conventional drilling (thus saving extraction of a drill pipe to replace a worn bit), and are less likely to break down hole because they have no moving parts. However, steel is not readily drillable with a PDC drill bit. Steel can be drilled with mill tooth bits and junk bits, but PDC bits are particularly susceptible to damage; i.e. chipping of the cutters and so reduce bit performance when drilling ahead. Accordingly, it is desirable to have a means for creating a cement plug that does not contain steel components therein.

BRIEF SUMMARY OF THE INVENTION

According to a first aspect of the present invention, there is provided an apparatus for setting a cementitious material plug in a wellbore, having a down hole assembly comprising: a membrane for containing cementitious material within a volume substantially bounded by the membrane; and a membrane delivery device for housing the membrane therein in its undelivered state, the membrane delivery device configured to extrude the membrane from a down hole end of the membrane delivery device in response to receiving a cementitious material slurry, such that the membrane receives said cementitious material slurry therein.

The membrane delivery device may extrude the membrane in as much as that the membrane delivery device is configured to push, squeeze and/or thrust the membrane out, in response to a pressure of fluid within the membrane delivery device. The pressure of fluid within the membrane delivery device may act on a down hole end of the membrane.

The present invention allows an operator to pump cementitious material into a flexible bag that will prevent the cementitious material being contaminated with drilling mud, and allow the bag to fill and take the shape of and/or conform to a washout or over gauge hole, thus reducing the contamination and allowing the cementitious material to set and provide a good plug. In particular, the apparatus allows a less contaminated cementitious material plug to be placed in a wellbore, even if the wellbore is over gauge and/or of irregular shape.

As the membrane is extruded, it expands and/or inflates (taking up the shape of the hole) the annulus between the membrane and the well bore is reduced. A smaller annulus causes higher annular velocities of fluid, and thereby turbulent flow, which will displace the well fluid (mud) from any nooks and crannies within the hole. Cementitious material passing up the annulus will then take its place. In this way, good bonding of cementitious material with the hole may be made. As the apparatus can expand to a greater diameter than the previous casing through which it is run, the annulus around the invention is smaller, thus enabling turbulent flow even in an over gauge hole.

The apparatus may allow sidetracking from the high side of a horizontal hole, because the device may provide a full bore cementitious material plug. The apparatus may leave no steel components in a set plug. In this way, the plug may be drillable with a PDC bit.

Suitable cementitious material may be, for instance, cement. The cementitious material may be any fluid that may harden under certain conditions. The cementitious material may therefore be a cement slurry that hardens into solid cement. The cementitious material may be, before or after hardening, cement, grout, concrete, fluid, liquid, paste, slurry and/or a colloid such as a foam, solid foam, liquid aerosol, emulsion, gel, solid aerosol, sol and/or solid sol.

The membrane may be substantially flexible. In this way, a better seal with a well bore may be formed when setting a plug.

The membrane may be substantially tubular in form and/or of substantially tube shape when inflated and/or expanded. In this way, the internal profile of a well bore may be approximated. The membrane may be and/or comprise a bag. The membrane may be cylindrical in form. The membrane may be tubular and/or open ended at one or both ends. The membrane may be provided with a closure mechanism at the or each opening, such that the membrane may be sealed once it has been filled with cementitious material. The closure mechanisms may be a sealing mechanism such as valves, rubber flaps, flanges or any other form of sealing mechanism. In this way, the apparatus may provide a full cementitious material plug in substantially horizontal (for instance, between 80 and 100 degrees from vertical), inclined (for instance less than 90 degrees from vertical) and uphill holes (for instance above 90 degrees from vertical).

The membrane may be releasably and/or frangibly connected to the membrane delivery device at an up hole end of the membrane. The frangible member may be made from the same material as the membrane, or another suitable material. In this way, the membrane may be deposited in the well hole and the assembly may be removed. Thus, the assembly would not cause an obstruction to subsequent drilling if it were deemed necessary to drill out the cementitious material plug.

The membrane may be folded, gathered, pleated, creased, crumpled and/or doubled over within the membrane delivery device when in its undelivered state. The membrane may be folded, gathered, pleated, creased, crumpled and/or doubled over within the membrane delivery device when in its undelivered state with a length between approximately one third and one sixth of its unfolded length. For instance, approximately one third, one quarter, one fifth or one sixth. The membrane may have an extended length of between approximately 5 m and 50 m, in particular between approximately 10 m and 40 m, and particularly approximately 20 m or 30 m. The membrane may be folded, gathered, pleated, creased, crumpled and/or doubled over within the membrane delivery device when in its undelivered state with a width of between approximately one half and one eighth of its unfolded width. For instance, approximately one half, one third, one quarter, one fifth, one sixth, one seventh or one eighth. The membrane may have an expanded width of between approximately 10 cm and 100 cm, in particular between approximately 30 cm and 80 cm, and particularly approximately 50 cm. The membrane may be folded, gathered, pleated, creased, crumpled and/or doubled over within the membrane delivery device when in its undelivered state with a width of between approximately one three hundredth to one eight hundredth of its unfolded length.

In one embodiment, the bag may have an expanded length approximately five times that of the contracted apparatus. For instance, an apparatus to make a 30 m plug would only be 6 m long, which could be made in two or more lengths and of a diameter of 63 mm (2½ inches) and expand to approximately 48 cm (19 inches) in diameter. The apparatus could be between approximately 5 m and 15 m in length, in particular between approximately 6 m and 13.5 m, particularly approximately 9.5 m or 13.5 m, to fit within a standard joint of drill pipe. In this way, the apparatus may be easier to transport.

The membrane may be substantially porous. The membrane may be made of a flexible material such as a woven and/or fibrous material, for instance a fibre mat. Alternatively, the membrane may be a continuous sheet material. The membrane may be nylon, nylon rip stop, plastic material, textile, synthetic and/or natural material, hessian, cloth, rubber material and/or any other form of material. Cementitious material may 'bleed through' to help the membrane adhere to the well bore. Cementitious material additives such as fibre, lost circulation material and/or hardened cementitious material particles may seal the pours in the membrane, preventing further passage of cementitious material through the pores. In this way, the membrane may be prevented from collapsing after the cementitious material is pumped. In alternative embodiments the membrane may be substantially impermeable.

The membrane may be configured to decompose upon heating. The membrane may be made from a material that weakens upon heating. For instance, the membrane may decompose when heated, e.g. by hardening cementitious material. Cementitious material hardening is an exothermic reaction. In addition, down hole temperature is often higher than surface temperatures. In this way, the bag may decompose once the cementitious material is semi-hardened such that the cementitious material is sufficiently solid not to flow away from the region in which it is desired, the cementitious material may bond with the wall without being obstructed by the bag and/or the bag may not present an obstruction to re-drilling of the hole.

The down hole assembly may further comprise a nose member, coupled to a down hole end of the membrane. The nose member may be located in its undelivered state adjacent the down hole end of the membrane delivery device. The nose member may be releasably coupled to the membrane delivery device. A down hole end of the membrane may be scrunched together and may be joined to a nose member, which may be hollow. The nose member may be releasably attached to the membrane delivery device, for instance by a shear pin. Additionally, the nose member may be sealed with an "O" ring.

The nose member may have a smooth leading profile such that damage to the membrane delivery device by obstructions within a well bore can be prevented. The nose member may be provided with a bull nose inside which fingers may be contained. This bull nose may also have the effect of helping the apparatus to pass obstructions and may protect the bottom of the drill pipe.

The nose member may have an internal bore for the passage of cementitious material there through. The nose member may comprise a ball seat disposed within the internal bore, for receiving an activation ball thereon such that the internal bore becomes blocked. The nose member may be substantially non-metallic.

The nose member may comprise sprung fingers, for holding the nose member in place within a well bore. The nose member may comprise one or more fingers for engaging the internal wall of a hole to prevent movement within the hole. The nose member may comprise a sheath, for maintaining the fingers in a retracted position. The sheath may be configured to release the fingers in response to the apparatus being deployed within a hole. At least one of the fingers may be arranged to project substantially up hole and/or down hole in their extended position. In this way, movement of the apparatus may be prevented in that direction. The fingers may be held in a sprung manner within the sheath in their retracted position. The fingers may be made from carbon fiber, or any other suitable material. The fingers may be configured to spring out of the sheath in response to the apparatus being deployed down hole. For instance, the fingers may be configured to spring out as the membrane is extruded from the membrane delivery device and/or as the nose member decouples from the inner flow pipe. Alternatively or additionally, the fingers may be configured to spring out in response to some other activation method, for instance, a control signal passed down a control line or received via pressure waves in the well fluid.

The membrane delivery device may be configured to fit wholly or partially within a section of drill pipe. The apparatus may be sized to fit inside a standard joint of drill pipe. In this way, the apparatus may be protected from damage by the drill pipe, for instance, the apparatus may be spaced from any obstructions within the well bore such as a ledge or cutting accumulations. Accordingly, the apparatus may be made out light weight and/or fragile materials that would usually be unsuitable for running in hole. The apparatus may undergo less ware than down hole assembly coupled to an end of a drill pipe, due to a shielding effect of the section of drill pipe. In particular, the apparatus avoid contact with the well bore when run in hole. The annulus between the drill pipe and the well bore may be unrestricted because the apparatus may be located inside a drill pipe section. The apparatus may therefore allow greater run in hole speeds due to a reduced surge pressure. Surge pressures on formations can cause the formation to break down and/or fracture, leading to a loss of drilling fluid and a potential well control situation. In previous arrangements, surge pressures can be high enough to fracture surrounding formations leading to a loss of drilling time and/or equipment, and possible problems controlling the down hole environment. The apparatus may be easier to transport than conventional down hole assemblies. For example, 10 m of 17.8 cm (7 inch) fibre glass casing in sections may fit inside a helicopter and/or may be stored at a rig for use when necessary. The apparatus may be sized for use with drill pipe having a diameter of approximately 91 cm, 76 cm, 61 cm, 51 cm, 45 cm, 34 cm, 31 cm, 24 cm, 20 cm, 18 cm, 17 cm, 15 m 14 cm, 13 cm and/or 9 cm, or any other suitable size.

The membrane delivery device may comprise a frictional gripping arrangement, for gripping an interior of a section of drill pipe, for instance the tool joint bore back. The membrane delivery device may comprise a suspension block incorporating the frictional gripping arrangement. The apparatus may comprise a suspension block at an up hole end of the apparatus. The suspension block may sit inside a tool joint and/or may be configured to allow the assembly to be suspended from the up hole end. The apparatus may comprise an inner flow pipe and/or an outer sheath. The flexible membrane may be disposed between the inner flow pipe and the outer sheath. The nose member may also fit inside the outer sheath. In some embodiments, the nose member is a loose fit inside the outer sheath. The outer sheath and/or the inner flow pipe may be made from a thin walled material such as fibreglass and may have a diameter to fit inside a standard joint of drill pipe that is conventionally used as a cement stinger. The outer sheath and/or the inner flow pipe may be connected to the suspension block. The suspension block may have a central bore for the passage of fluid from a connected drill pipe into the interior of the inner flow pipe. The outer sheath and/or the inner flow pipe may comprise bleed holes such that hydrostatic pressure equalisation may be obtained when running in hole.

The apparatus may comprise a frangible member coupled between the membrane and the suspension block. The frangible member may be a weak link between the membrane and the suspension block.

The membrane delivery device may comprise an inner flow pipe for the passage of cementitious material there through. The inner flow pipe may be in fluid communication with the internal bore, when the membrane is in its undelivered state. The apparatus may have a central and/or axial bore. The central bore may be configured to be open when run in hole. In this way, high run in hole speeds may be maintained during placement. That is, circulation of fluid may be enabled in order for the apparatus to pass obstructions and/or constrictions such as cuttings beds. The apparatus may be configured to allow multiple plugs to be set in a conventional manner either before or after the cementitious material bag has been deployed; that is, by allowing cementitious material to be pumped through the central bore into the hole to be plugged.

The membrane delivery device may comprise an outer sleeve arranged coaxially with the inner flow pipe, such that the outer sleeve and inner flow pipe define an annular region in which the membrane is housed in its undelivered state. The membrane may be packed into the annular region between the outer sheath and inner pipe. The annular region may be open at a down hole end of the membrane delivery device. An annular region between the inner flow pipe and/or the outer sheath may be open at one end, for instance the lower end, and bleed holes may be provided in the outer sheath, such that hydrostatic pressure may be allowed to equalise. In this way, hydraulic lock is prevented.

The membrane delivery device may be substantially non-metallic. The membrane delivery device may be constructed from multiple tubular components connected end to end. The apparatus may be assemblable from two or more units having a length that may fit within a standard joint of a drill pipe. In this way, the apparatus may be assembled at a drilling site. The apparatus may comprise a plurality of members. A member may be a single length of drill pipe, drill collar, casing, tubing, joint, and/or similar section. A member may have a connecting region at each end. The connecting region may be a threaded region. Alternatively, the threaded region may be a hanger region; that is, a circular region having a frictional gripping arrangement of slips and/or packing rings used to suspend one member from another member. A member may have a length of between approximately 5 meters to 14.5 meters. The apparatus may comprise a first member and a second member. The first member may comprise a hanger member, having a hanger region at a first end, for connection of the first member to a drill pipe. The second member may be coupled to an opposing end of the first member and may comprise a nose member. The second member may be directly coupled to the first member. Alternatively, the second member may be coupled to the first member via one or more intermediate members.

The down hole assembly may further comprise a top plug member disposed at an up hole end of the membrane. The top plug member may be a sliding sleeve and/or sliding ring. The top plug member may be configured to slide within the membrane delivery device. The top plug member may be releasably and/or frangibly coupled to the membrane delivery device. The membrane may be provided at an upper end with a sliding ring. The sliding sleeve may be attached to the suspension block, for instance, via a frangible member. In particular, the frangible member may be coupled between the sliding ring and the suspension block. In this way, the cementitious material filled membrane may 'break away' from the suspension block when filled.

The sliding ring may have a longitudinal key slot, which may enable rotation of the membrane when partially filled with cementitious material. In this way, the membrane may form individual cells of cementitious material separated by a twisting of the membrane.

The top plug member may comprise a sealing mechanism, for sealing an up hole end of the volume substantially bounded by the membrane, when the membrane is in its delivered state. The sealing mechanism may be a flapper valve for closing the membrane at an upper end. The top plug member may have the sealing mechanism held open by virtue of the inner pipe passing there through. The sealing mechanism may be configured to close in response to the top plug member being pulled off the inner pipe by the membrane. For instance, the flapper valve may be closed by a rubber band pulling on it. The flapper valve may have a curved face, such that smooth sliding of the sliding ring may be enabled. In this way, the flapper valve may prevent sticking and/or jamming of the sliding ring. The top plug member may be substantially non-metallic.

The apparatus may further comprise a dart configured to be sent down a drill pipe to the down hole assembly such that cementitious material and/or well fluid at a pressure below a predetermined threshold may not pass beyond the dart. The dart may comprise a dart seal around a periphery of the dart. The dart may comprise an internal passage for fluid communication with the inner flow pipe. The internal passage may comprise an enlarged region for receiving an activation ball therein.

In particular, the apparatus may be configured such that it may be activated with a hollow pipe wiper dart, which may have a hole there through. A region within the hole (in some embodiments, substantially mid-way through the hole) may be enlarged such that a space for receiving an activation ball therein may be formed. The dart may be resilient and/or flexible. For instance, the dart may be formed of a rubber type compound such that an activation ball may be a push fit inside the dart.

The apparatus may further comprise an activation ball configured to be received within the enlarged region such that the activation ball may be forced out of the enlarged region in response to a pressure of cementitious material above a predetermined threshold pressure.

The apparatus may further comprise an activation ball configured to be received on the ball seat such that the internal bore becomes blocked.

The apparatus may further comprise a top wiper ball configured to be sent down a drill pipe to the down hole assembly such that cementitious material and/or well fluid may not pass beyond the top wiper ball. In particular, wiper balls, for instance compressible wiper balls may be pumped through the tool. The wiper balls may be substantially frangible. The central bore of the suspension block may be sized to cause damage to a wiper ball, such that it may be broken into pieces that may pass through the hole in the nose member. The hole in the nose member may have a smaller cross section than the central hole in the suspension block.

The down hole assembly may comprise bleed holes for allowing fluid flow between regions having different hydrostatic pressures. The suspension block may have a hole providing communication between the central bore, a region inside the membrane and a region outside the membrane. The hole may include a shuttle valve therein that may be held open by a sprung mechanism, such as a spring or elastic band, to allow hydrostatic equalisation during running of the apparatus within the wellbore. The shuttle valve may be configured to close during pumping of cementitious material. The nose member may comprise a bleed hole and/or a pressure relief valve or bleed valve. The bleed valve may be closed when the nose member is located in a fitted position on the inner flow pipe. The bleed valve may be open when the nose member is in a position spaced from the inner flow pipe. The pressure relief valve may be disposed within the bleed hole such that, when there is no pumping of cementitious material the valve is sealed. The pressure relief valve may be spring loaded, such that the valve closes in response to cementitious material pumping stopping.

The apparatus may comprise a plurality of membranes. In particular, the apparatus may comprise a plurality of membranes arranged for deployment independently and/or sequentially. In this way, multiple plugs may be placed in different respective locations. Alternatively, if after placing a first plug using a first membrane it is apparent that a second plug is necessary, a second membrane may be deployed. Alternatively, or additionally, the apparatus may comprise a plurality of membranes arranged for deployment concurrently, for instance, a first membrane may be located outside a second membrane. In this way, a multi-skin plug may be placed comprising of a series of onion-like layers. Alternatively, a hollow plug may be placed in which an inner and outer membrane may define a substantially torroidal, ring-like and/or annular region therebetween, that may be filled with cementitious material.

According to a second aspect of the present invention, there is provided a method for setting a cementitious material plug in a wellbore, comprising: providing an apparatus according to any preceding claim; coupling the apparatus to a down hole end of a drill pipe; running the apparatus on the end of the drill pipe into a well bore to a desired location; pumping cementitious material down the drill pipe; and extruding the membrane filled with cementitious material from the membrane delivery device.

The apparatus may be coupled inside the bottom joint of drill pipe. The apparatus may be run inside the bottom joint of drill pipe into the well bore.

The method may optionally comprise one or more of the steps: pumping a first quantity of cementitious material down the drill pipe to form a first cementitious material plug; sending a dart down the drill pipe ahead of a second quantity of cementitious material, the dart having an activation ball within the enlarged region of the dart's internal passage; sending the second quantity of cementitious material down the drill pipe to increase pressure behind the dart; forcing the activation ball out of the enlarged region, to allow cementitious material to flow through the internal passage; passing the activation ball and cementitious material through the inner flow pipe; receiving the activation ball on the ball seat to block the internal bore; releasing the nose member from the membrane delivery device in response to an increase in pressure of cementitious material behind the activation ball; extruding the cementitious material filled membrane from the membrane delivery device; partially extracting the drill pipe from the well bore to allow placement of the cementitious material filled membrane in the well bore; rotating the drill pipe to form a first cell of cementitious material within a first region of the membrane; releasing the top plug member from the membrane delivery device to form a seal at the up hole end of the membrane and form a second cementitious material plug; pumping a third quantity of cementitious material down the drill pipe to form a third cementitious material plug; and/or sending a top wiper ball down the drill pipe behind the final quantity of cementitious material.

In operation, the assembly of the present invention may be coupled to a down hole end of a drill pipe, which may be rotated in order to move the assembly down a well bore. When the assembly reaches a desired location for setting a cementitious material plug, rotation of the drill pipe may be stopped. In particular, the bottom of the assembly may be positioned to be located at the setting depth of the bottom of the desired cementitious material plug.

An activation dart may be released into the drill pipe and may be pumped down hole with cementitious material slurry. When the dart lands on an up hole end of the assembly, downward movement of the dart may be prevented, but an increase in pressure may force an activation ball out of the dart and down to the nose member, where it may land in a ball seat. This may prevent circulation of cementitious material out of the front of the nose member, and the increase in pressure shears off the nose member and the cementitious material fills the membrane, causing it to extrude from its sheath. At the same time, the apparatus is raised by a rig at the up hole end of the drill pipe, allowing the cementitious material filled membrane to be extruded into position within the well bore. In oilfield parlance "Pump & Pull". As more cementitious material is pumped down the drill pipe, the membrane may fill and/or expand to take up the shape of the well bore.

The membrane may be sealed at an upper and/or lower end by rotating the drill pipe, thereby twisting the membrane around a central constriction.

When the membrane is full of cementitious material, the up hole end of the membrane rips away from the attachment block by virtue of a weak link, thus leaving a membrane of cementitious material in the well bore. In this way, the cementitious material may be substantially uncontaminated. To provide a good anchor of the cementitious material bag to the wellbore, a bleed hole in the nose member may allow the passage of some cementitious material to the region beyond the apparatus, and the annular region around the membrane and back up the hole between the well bore and the outside of the membrane. This has the added advantage that the annulus between the membrane and the wellbore is much reduced compared to a standard stinger and over gauge hole, and hence a better chance of cementitious material getting into the washouts rather than a mixture of drilling mud and cementitious material. Should the well bore be a gauge hole (i.e. smaller than the cross section of the membrane when expanded), excess cementitious material passes through the bleed hole and into the annulus between the wellbore and the cementitious material bag. Once the cementitious material bag is separated normal circulation and rotation can continue.

After the required amount of cementitious material has been pumped, a top wiper ball (or a hollow plug with a rupture membrane) is put into the drill pipe. This keeps the cementitious material isolated from the drilling fluid as it travels down the drill pipe.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
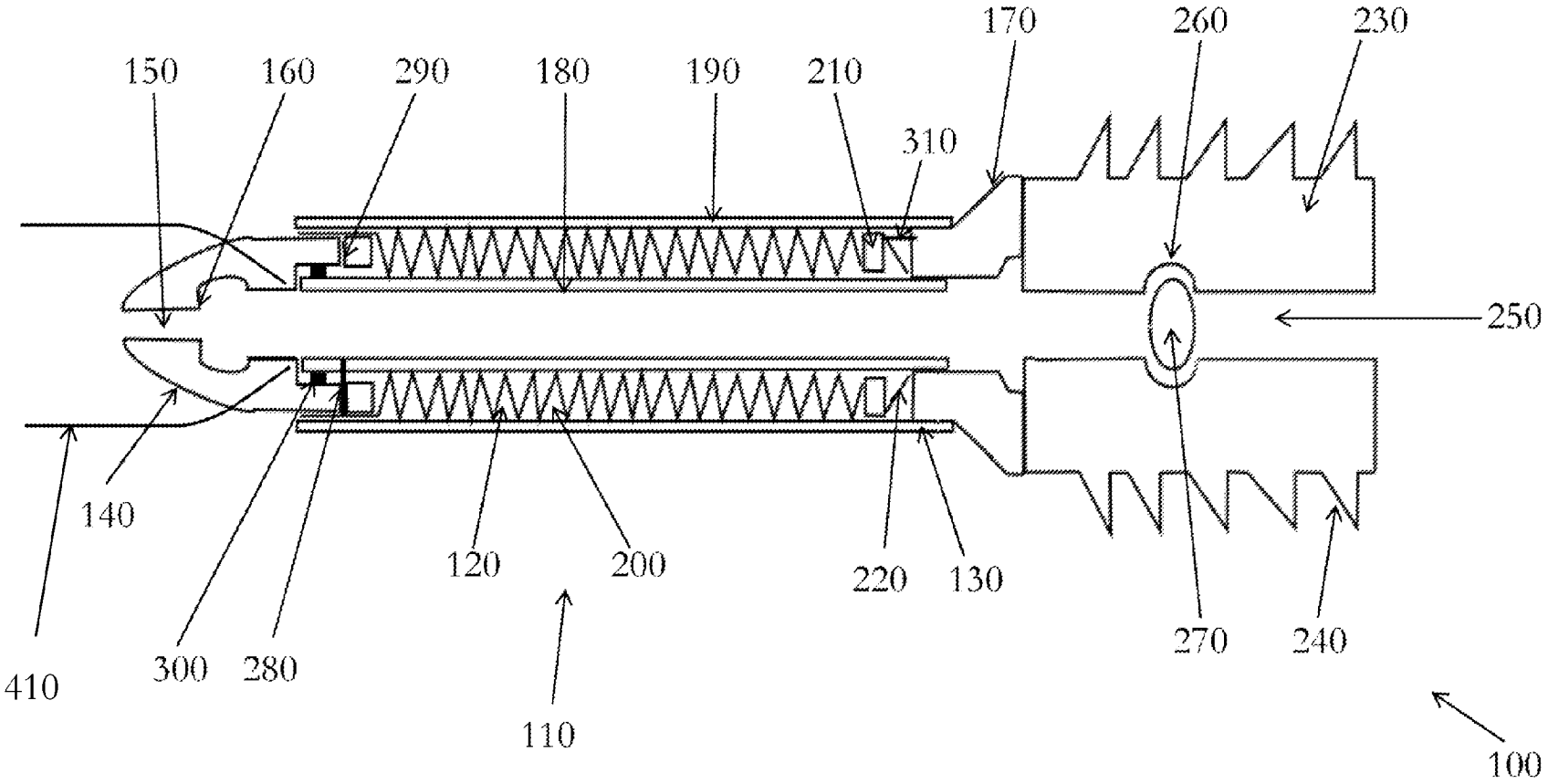
FIG. 1 is a cross sectional view of an apparatus according to a first embodiment of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics of any embodiment or aspect of the invention may be combined in any suitable manner, as would be apparent to one of ordinary skill in the art from this disclosure, in one or more embodiments.

Similarly, it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may, in some embodiments, mean only one.

The invention will now be described by a detailed description of several embodiments of the invention. It is clear that other embodiments of the invention can be configured according to the knowledge of persons skilled in the art without departing from the underlying concept or technical teaching of the invention, the invention being limited only by the terms of the appended claims.

FIG. 1 shows a cross section of an apparatus 100 according to an embodiment of the present invention. The apparatus 100 comprises a down hole assembly 110 that includes a membrane 120 and an membrane delivery device 130.

The membrane delivery device 130 comprises a tubular inner flow pipe 180, a tubular outer sleeve 190, arranged coaxially outside the inner flow pipe 180 to form an annular region 200 therebetween, and a suspension block 170 having a substantially ring-like form and being located at an up hole end of the annular region 200, such that it maintains the inner flow pipe 180 and outer sleeve 190 in a fixed position relative to one another. The suspension block 170 is shaped to have an outwardly projecting profile such that it may grip an inner surface of a suitably sized drill pipe.

The membrane 120 is in the form of a tubular flexible nylon sheet having a diameter when inflated greater than the diameter of the outer sleeve 190, and a length when inflated greater than the length of the annular region 200. The membrane 120 is disposed within the annular region 200 and has been folded and/or pleated to fit.

An up hole end of the membrane 120 is bonded to a ring-like top plug member 210 that is slidably received in the annular region 200. The top plug member 210 is coupled to the suspension block 170 by a weak link 310. The weak link 310 is configured to break above a threshold tension, substantially less than the breaking threshold tension of the membrane 120. The top plug member 210 is also provided with a sealing mechanism 220 in the form of rubber flaps, which are folded within the annular region 200.

A down hole end of the membrane 120 is bonded to a nose member 140. The nose member 140 has a rounded profile and a central bore 150. The nose member 140 is configured to be inserted within the down hole end of the annular region 200 with its central bore 150 coaxial and in fluid communication with the interior of the inner flow pipe 180. The nose member 140 is held in place by a sheer pin 280 that connects the nose member 140 to the inner flow pipe 180. The sheer pin 280 is configured to break in response to a separation force of the nose member 140 from the inner flow pipe 180, the separation force being greater than a predetermined threshold force. Vibration of the nose member 140 with respect to the inner flow pipe 180 is limited by an 'O' ring 300 disposed around the down hole end of the inner flow pipe 180, within the annular region 200.

The nose member 140 includes a ball seat 160 within its internal bore 150 for receiving an activation ball 270 thereon, such that the activation ball 270 prevents and/or limits fluid (and in particular cementitious material) flow through the internal bore 150. FIG. 1 does not show the activation ball 270 located on the ball seat 160.

The nose member 140 also includes a bleed hole 290 between the internal bore 150 and an outer surface of the nose member 140. The bleed hole 290 shown is for illustrative purposes only, and may provide fluid communication between the outer surface of the nose member 140 and the internal bore 150. Embodiments of the invention are envisaged having varied numbers of bleed holes 290 at a variety of locations on the down hole assembly 110.

The apparatus 100 also includes a dart 230 for delivery down a drill pipe to the down hole assembly 110. The dart 230 is configured to rest on the suspension block 170 of the down hole assembly 110 with an internal passage 250 coaxial and in fluid communication with the interior of the internal flow pipe 180. The dart 230 is substantially cylindrical in form, and is provided with five ring-like dart seals 240 disposed around the periphery of the dart 230; however, it is noted that other numbers of ring-like dart seals 240 may be provided. The dart seals 240 are constructed from a flexible and resilient rubber material such that they may provide a fluid tight seal with the interior surface of a drill pipe.

The internal passage 250 of the dart 230 includes an enlarged region 260 approximately mid-way along the length of the internal passage 250. The enlarged region 260 is sized to receive an activation ball 270 therein. In particular, the enlarged region 260 is sized to maintain an activation ball 270 therein when the activation ball is subjected to a fluid pressure below a threshold fluid pressure.

In operation, the down hole assembly 110 is placed within a drill pipe, with its outwardly projecting profile gripping an inner surface of the drill pipe, such that it is held in position. As noted above, the internal bore 150, the interior of the inner flow pipe 180 and the ring-like suspension block 170 are disposed axially symmetrically and in fluid communication. In this way, as the drill pipe is run down hole, well fluid may flow through the down hole assembly 110, such that surge pressure is kept to a minimum.

Once the end of the drill pipe, which contains the down hole assembly 110 therein, reaches a first desired depth, cementitious material may be pumped down the drill pipe to exit the down hole assembly at the first desired depth. A cementitious material plug may be formed in a conventional manner.

The end of the drill pipe may be moved to a second desired depth, for instance, above the first desired depth. Alternatively, the drill pipe may be maintained at the first desired depth. The dart 230 is sent down the drill pipe and forms a seal with the inner surface of the drill pipe in which the down hole assembly 110 is placed. The dart 230 comes to rest on the suspension block 170 with its internal passage 250 axially aligned and in fluid communication with the interior of the inner flow pipe 180.

Cementitious material is pumped down the drill pipe, and is unable to pass the dart 230 due to the dart seal 240 around the periphery of the dart 230 and the activation ball 270 within the internal passage 250. Once a pressure of pumped cementitious material within the drill pipe exceeds a predetermined threshold, the activation ball 270 is released from the enlarged region 260 and passes through the interior of the inner flow pipe 180, into the internal bore 150, and comes to rest on the ball seat 160, obstructing the internal bore 150. Cementitious material passes through the interior of the inner flow pipe 180 and is prevented from flowing out of the nose member 140 through the internal bore 150.

Once the pressure of pumped cementitious material within the inner flow pipe exceeds a predetermined threshold, the shear pin 280 will break. The nose member 140 becomes detached from the membrane delivery device 130, other than via the membrane 120. The nose member 140 may move down hole away from the membrane delivery device 130. Alternatively or additionally, the nose member 140 may remain at a substantially fixed location within the well bore. The drill pipe and the membrane delivery device may be moved up hole, such that the membrane 120 is pulled out of the annular region 200 by the nose member 140. As the membrane 120 moves out of the annular region 200, it is filled with cementitious material and expands to conform to the interior profile of the well bore. The bleed hole 290 allows cementitious material to pass into the well bore around the membrane 120 and/or in front of the nose member 140.

Optionally, cementitious material pumping may be slowed and/or stopped and the drill pipe may be rotated without being moved up/down hole. In this way, the membrane may be twisted to pinch off a cell of cementitious material adjacent the nose member 140. This procedure may be repeated to pinch off a series of cells.

Once the membrane 120 has moved out of the annular region 200 to its full extension, the weak link 310 will break, allowing the top plug member 210 to move slidably within the annular region 200 toward the down hole end of the membrane delivery device 130. As cementitious material continues to be pumped down hole, the top plug member 210 will exit the annular region 200 and the sealing mechanism 220 acts to seal a region within the membrane 120 to prevent substantial loss of cementitious material from within.

Sprung fingers 410 are shown on the nose member 140, in a retracted position as in the case where the apparatus has not yet been deployed.

Figure 2:
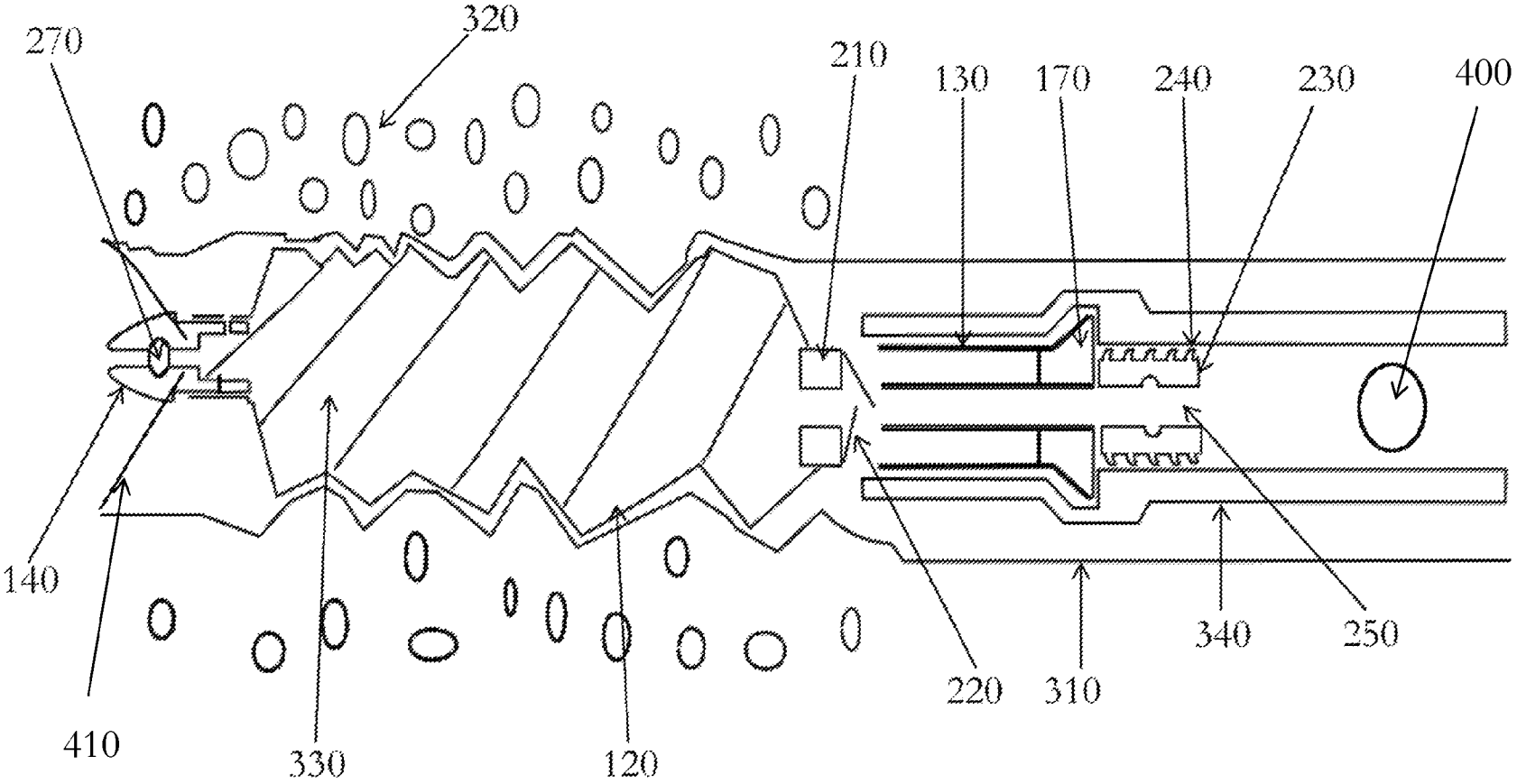
FIG. 2 is a cross sectional view of the apparatus of FIG. 1, deployed in an irregularly shaped well bore.

FIG. 2 shows a cross sectional view of the apparatus 100, deployed in an irregularly shaped well bore 310 in bedrock 320, with the sprung fingers 410 engaging with the bedrock 320. The activation ball 270 is located within the nose member 140. The membrane 120 is filled with cementitious material 330 and conforms to the shape of the well bore 310. The sealing mechanism 220 substantially seals the ring shape top plug member 210. The membrane delivery device 130 is disposed within a drill pipe 340, with an outwardly projecting profile of the suspension block 170 received within a recess in the interior surface of the drill pipe 340 and/or the drill pipe tool joint. The dart 230 rests on the suspension block 170. The dart seal 240 are deformed by the drill pipe 340 and form a seal therewith.

Once the region within the membrane 120 is substantially sealed by the sealing mechanism 220, cementitious material may continue to be pumped down the drill pipe to exit the down hole assembly adjacent the membrane. Alternatively and/or additionally, the end of the drill pipe may be moved to a depth above the membrane 120. A cementitious material plug may be formed in a conventional manner above the membrane 120.

A top wiper ball 400 may be sent down the drill pipe behind the cementitious material, to separate the cementitious material from the mud being used to displace the cementitious material down the work string to the device. The top wiper ball 400 will land on plug 250, and may have a rupture disc that breaks at a predetermined pressure allowing further circulation. In some embodiments, the top wiper ball 400 may clear the inside of the drill pipe 340. The top wiper ball 400 may crumble upon contact with the dart 240, such that the component parts pass out through the membrane delivery device 130 into the well bore 310. In this way, cementitious material may be prevented from hardening within the drill pipe 340. Well fluid and/or mud may be pumped down the drill pipe 340 as the drill pipe 340 is extracted from the well bore 310.

What is claimed is:

1. Apparatus for setting a cementitious material slurry plug in a wellbore, having a down hole assembly comprising:

a membrane for containing a cementitious material within a volume substantially bounded by the membrane; and a membrane delivery device for housing the membrane therein in an undelivered state, the membrane delivery device configured to extrude the membrane from a down hole end of the membrane delivery device in response to receiving a cementitious material slurry, such that the membrane receives said cementitious material slurry therein.

2. The apparatus of claim 1, wherein the membrane is substantially flexible.

3. The apparatus of claim 1, wherein the membrane is substantially tubular in form.

4. The apparatus of claim 1, wherein the membrane is releasably and/or frangibly connected to the membrane delivery device at an up hole end of the membrane.

5. The apparatus of claim 1, wherein the membrane is substantially porous.

6. The apparatus of claim 1, wherein the down hole assembly further comprises a nose member, coupled to a down hole end of the membrane.

7. The apparatus of claim 1, wherein the down hole assembly further comprises a nose member, coupled to a down hole end of the membrane, and the nose member has an internal bore for the passage of cementitious material slurry there through.

8. The apparatus of claim 1, wherein the down hole assembly further comprises a nose member, coupled to a down hole end of the membrane, and the nose member comprises a ball seat disposed within the internal bore, for receiving an activation ball thereon such that the internal bore becomes blocked.

9. The apparatus of claim 1, wherein the down hole assembly further comprises a nose member, coupled to a down hole end of the membrane, and the nose member comprises sprung fingers, for holding the nose member in place within a well bore.

10. The apparatus of claim 1, wherein the membrane delivery device comprises an inner flow pipe for the passage of cementitious material slurry there through.

11. The apparatus of claim 1, wherein the membrane delivery device comprises an inner flow pipe for the passage of cementitious material slurry there through, and an outer sleeve arranged coaxially with the inner flow pipe, such that the outer sleeve and inner flow pipe define an annular region in which the membrane is housed in the undelivered state.

12. The apparatus of claim 1, wherein the down hole assembly further comprises a top plug member disposed at an up hole end of the membrane.

13. The apparatus of claim 1, wherein the apparatus further comprises a dart configured to be sent down a drill pipe to the down hole assembly such that cementitious material slurry and/or well fluid at a pressure below a predetermined threshold may not pass beyond the dart.

14. The apparatus of claim 1, wherein the apparatus further comprises a dart configured to be sent down a drill pipe to the down hole assembly such that cementitious material slurry and/or well fluid at a pressure below a predetermined threshold may not pass beyond the dart, and the dart comprises an internal passage for fluid communication with the inner flow pipe.

15. The apparatus of claim 1, wherein the apparatus further comprises a dart configured to be sent down a drill pipe to the down hole assembly such that cementitious material slurry and/or well fluid at a pressure below a predetermined threshold may not pass beyond the dart, the dart comprises an internal passage for fluid communication with the inner flow pipe, and the internal passage comprises an enlarged region for receiving an activation ball therein.

16. The apparatus of claim 1, wherein the apparatus further comprises a dart and an activation ball, the dart configured to be sent down a drill pipe to the down hole assembly such that cementitious material slurry and/or well fluid at a pressure below a predetermined threshold may not pass beyond the dart, the dart comprises an internal passage for fluid communication with the inner flow pipe, and the internal passage comprises an enlarged region for receiving an activation ball therein, and the activation ball configured to be received within the enlarged region such that the activation ball is forced out of the enlarged region in response to a pressure of cementitious material slurry above a predetermined threshold pressure.

17. The apparatus of claim 1, wherein the down hole assembly further comprises a nose member, coupled to a down hole end of the membrane, and the nose member comprises a ball seat disposed within the internal bore, for receiving an activation ball thereon such that the internal bore becomes blocked, and wherein the apparatus further comprises an activation ball configured to be received on the ball seat such that the internal bore becomes blocked.

18. The apparatus of claim 1, wherein the apparatus further comprises a top wiper ball configured to be sent down a drill pipe to the down hole assembly such that cementitious material slurry and/or well fluid does not pass beyond the top wiper ball.

19. The apparatus of claim 1, wherein the down hole assembly comprises bleed holes for allowing fluid flow between regions having different hydrostatic pressures.

* * * * *